US007212158B2

(12) United States Patent
Dai

(10) Patent No.: US 7,212,158 B2
(45) Date of Patent: May 1, 2007

(54) METHOD AND APPARATUS FOR BEAMFORMING BASED ON BROADBAND ANTENNA

(75) Inventor: Yanzhong Dai, Shanghai (CN)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/551,311

(22) PCT Filed: Mar. 17, 2004

(86) PCT No.: PCT/IB2004/050263

§ 371 (c)(1),
(2), (4) Date: Sep. 28, 2005

(87) PCT Pub. No.: WO2004/088794

PCT Pub. Date: Oct. 14, 2004

(65) Prior Publication Data

US 2006/0181456 A1 Aug. 17, 2006

(30) Foreign Application Priority Data

Apr. 1, 2003 (CN) ..... 03 1 09019

(51) Int. Cl.
*H01Q 3/00* (2006.01)

(52) U.S. Cl. ..... 342/377; 342/373

(58) Field of Classification Search ..... 342/154, 342/157, 373, 377–378, 383; 455/562.1
See application file for complete search history.

(56) References Cited

U.S. PATENT DOCUMENTS 4,743,911 A 5/1988 Evans
5,726,662 A 3/1998 Hopwood
6,697,009 B2 * 2/2004 Yu ..... 342/17

* cited by examiner

*Primary Examiner*—Dao L. Phan

(57) ABSTRACT

A beamforming method based on broadband antenna is provided, comprising: detecting the frequency of input signals of an antenna; determining the effective antenna aperture between elements of the antenna array according to the detected frequency; computing the weight vector of each element of the antenna array to the signals according to the determined effective antenna aperture and the transmission function of the antenna array; multiplying the input signals with said weight vector of each element of the antenna array to the signals, combining them and outputting the beam signals. By performing weighting operation respectively to the input signals after a series of delaying operation, and then combining them, the single digital signals can be acquired. This effectively reduces the odds produced by the antenna between transmitting signals and receiving signals, and thus dramatically improves the communication quality.

17 Claims, 6 Drawing Sheets

METHOD AND APPARATUS FOR BEAMFORMING BASED ON BROADBAND ANTENNA

FIELD OF THE INVENTION

The present invention relates generally to a beamforming method based on broadband antenna, and more particularly, to a beamforming method implemented in time domain or in frequency domain based on broadband antenna.

BACKGROUND ART OF THE INVENTION

In common mobile communication environment, signals communicated between the base station and the mobile terminal are transmitted along several paths between the receiver and the transmitter. Due to difference in propagation paths, the same signal may arrive at the receiver via different paths with different propagation delays and DOAs (directional angle of arrival), thus multi-path interference and signal fading are caused.

By taking full advantage of the space property of signals, array antenna techniques can reduce multi-path interference and signal deterioration effectively, improve system capacity and QoS markedly, and thus won wide applications in real life.

For the array antenna, beamforming is a basic function. That is, the array antenna can perform operations like delaying, weighting and combining to the signals received by the antenna elements, to form antenna beams whose major lobe aims at the direction of the user signals and null at that of the interference signals, so as to suppress the interference. Thereby the beams formed by the array antenna have significant effect on system performance.

FIG. 1 is a schematic diagram illustrating a one-dimension linear array antenna comprising M elements. As shown in FIG. 1, θ is the incident signal elevation, d is the space between elements (geometrical aperture), and all elements are assumed to have the same space. The half-power beam width of the array antenna, $\theta_{0.5}$, is approximately:

$$\theta_{0.5} \approx \frac{50.8 \cdot c}{M \cdot d \cdot f} \tag{1}$$

wherein M is the number of antenna elements, f is the carrier frequency of the signals, and c is velocity of light which equals to $3\times10^8$ m/s.

The geometrical aperture d, and the number of antenna elements M, are generally constant, which means the length of the antenna array, M·d, is constant too.

As it can be seen from equation (1), if the length of the antenna array M·d, is fixed, the antenna can form beams with different width when receiving signals with different frequencies. The higher the frequency is, the narrower the beam width is. Researches indicate that the beam width is in inverse ratio to the signal frequency. When broadband signals are received not in the direction to which the beam heads, the beam width of the antenna is relatively narrow for HF (high frequency) signals, so part of HF signals will fall to the null of the antenna pattern, thus the energy of these signals will be lost by the beam output. Accordingly, the output of the antenna is distorted.

To deal with the above-mentioned problem of antenna output distortion, the present invention provides a beamforming method based on broadband antenna.

SUMMARY OF THE INVENTION

It is, therefore, an object of the present invention to provide a method for beamforming based on broadband antenna In the proposed method, the effective aperture of the base antenna array is changed according to the signal frequency, so that the antenna shapes signals with different frequency into beams with constant width. On this premise, the weight vector of the antenna for different signal frequency is calculated, and then the input signals are weighted by the calculated weight vector to equalize the space gain of the antenna for each signal frequency, thus to eliminate distortion of the processed broadband signals.

Another object of the present invention is to provide a method and apparatus for beamforming with constant beam width, for use in mobile terminals with array antenna With this Rx (receiving) method and apparatus, the antenna elements can effectively reduce the odds produced when transmitting and receiving signals, thus dramatically improve the communication quality.

To achieve the object of the present invention, a method is proposed for beamforming based on broadband antenna, comprising: measuring the frequency of the antenna's input signals; determining the effective antenna aperture between the elements of the antenna array according to the measured frequency; computing the weight vector of each antenna element to the signals according to the determined effective antenna aperture and the transmission function of the antenna array; multiplying the input signals with said weight vector of each antenna element to the signals, combining them and outputting the beam signals.

To achieve the object of the present invention, a method for beamforming based on broadband antenna is proposed, wherein the step of multiplying the input signals with the corresponding weight vectors further includes: performing a series of delaying operations on the input signals; multiplying each delayed signal with the corresponding weight vector, and combining each delayed and weighted signal.

To achieve the object of the present invention, a method for beamforming based on broadband antenna is proposed, further comprising: performing FFT (Fast Fourier Transform) to transform input signals into signals in frequency domain before measuring the frequency of input signals; after combining the signals weighted by each element, performing IFFT (Inverse Fast Fourier Transform) to transform the combined signals in frequency domain into signals in time domain.

To achieve the object of the present invention, a beamforming apparatus based on broadband antenna is proposed, comprising: an effective antenna aperture computing module, for measuring the frequency of input signals of the antenna, and then determining the effective antenna aperture between elements of the antenna array according to the measured frequency; a weight vector computing module, for computing the weight vector of each element to the input signals according to the determined effective antenna aperture and the transmission function of the antenna array; a beam generating module, for multiplying the input signals with the weight vector of each said antenna element to the input signals, and then combining them and outputting the beam signals.

To achieve the object of the present invention, a beamforming apparatus based on broadband antenna is proposed, wherein the beam generating module further includes: a plurality of groups of delayers, each group for performing a series of delaying operations on the input signals; a plurality of groups of weight vector adjusting modules, each group for multiplying each delayed signal with said corresponding weight vector; a beam combining module, for combining the weighted signals, and outputting the combined signals.

To achieve the object of the present invention, a beamforming apparatus based on broadband antenna is proposed, further comprising: a time/frequency transforming module, for performing FFT (Fast Fourier Transform) to the input signals of the antenna, so as to provide the transtormed signals in frequency domain to said effective antenna aperture computing module; a frequency/time transforming module, for performing IFFT (Inverse Fast Fourier Transform) to the beam signals in frequency domain outputted from said beam generating module, to obtain beam signals in time domain.

BRIEF DESCRIPTION OF THE ACCOMPANYING DRAWINGS

DETAILED DESCRIPTION OF THE INVENTION

As shown in equation (1), antenna beams with different width can be acquired by changing the geometrical aperture d of the antenna; for signals with different frequency f; beams with constant width can be acquired by changing the geometrical aperture d to keep the half-power beam width $\theta_{0.5}$ unchanged.

The beamforming method proposed in the present invention is based on the above-mentioned principle. The antenna can shape beams with constant width for different signal frequency, by changing the effective aperture for different signal frequency. On this premise, the weight vector of the antenna array for different signal frequency is calculated, and then input signals are weighted with the calculated weight vector so that the space gain of the antenna for each signal frequency can be equalized.

In the following, a detailed description will be given to the procedure for beamforming method, by taking the continuous antenna array as an example.

Figure 1:
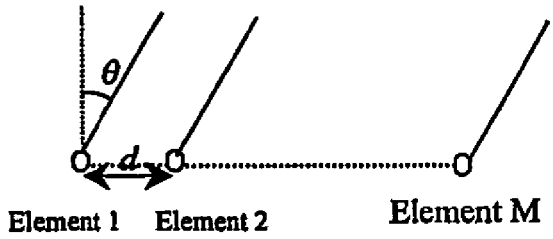
FIG. 1 is a schematic diagram illustrating an existing discrete linear antenna array.
Figure 2:
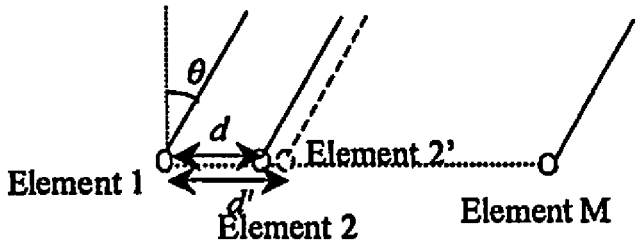
FIG. 2 is a schematic diagram illustrating space re-sampling in accordance with the present invention.

First, when the frequency of the signals inputted to the antenna element changes from original frequency $f_0$ to frequency $f_j$, the continuous antenna array should be re-sampled at the antenna element to ensure that its effective aperture changes from $d=\lambda_0/2$ to $d'=\lambda_j/2$, thus to keep the width of the antenna beam constant with the two frequencies. FIG. 2 is a schematic diagram for illustrating space re-sampling, wherein d is the effective aperture of element 2 corresponding to original frequency $f_0$, and d' is the effective aperture of the re-sampled element 2' corresponding to frequency $f_1$.

Second, just as a discrete antenna array may be taken as a digital filter, a continuous antenna array can be taken as an analog filter. Its transmission function can be represented in Equation (2):

$$h_a(x) = \sum_{i=1}^{M}\left[w_0(i)\cdot\frac{\sin\left(\pi\left(x-(i-1)\frac{\lambda_j}{2}\right)\Big/\frac{\lambda_j}{2}\right)}{\pi\left(x-(i-1)\frac{\lambda_j}{2}\right)}\right] \tag{2}$$

where $w_0(i)$ is the weight value corresponding to original frequency $f_0$, $\lambda_j$ the wave length corresponding to frequency $f_j$, and x the distance to the first antenna element (reference point). As shown in this transmission function, the effect of each antenna element on input signals is relevant to weight vector $w_0(i)$ corresponding to the original frequency $f_0$, the distance to the first antenna array element x, and the wave length of the input signals.

Third, the weight vector of each antenna element corresponding to frequency $f_1$ is computed according to the effective aperture of the new antenna element 2' and the transmission function of the continuous antenna array. Calculation of the weight vector is given in Equation (3):

$$w_j(m) \approx \frac{f_j}{f_0}\sum_{i=1}^{M}\left[w_0(i)\cdot\frac{\sin\left\{\pi\left[\frac{f_j}{f_0}(m-1)-(i-1)\right]\right\}}{\pi\left[\frac{f_j}{f_0}(m-1)-(i-1)\right]}\right] \tag{3}$$

$$m = 1, 2, \ldots M,\ i \neq m$$

Last, the input signals are multiplied with the weight vector computed as above and combined and outputted through a combiner to generate beams with constant width.

Figure 3:
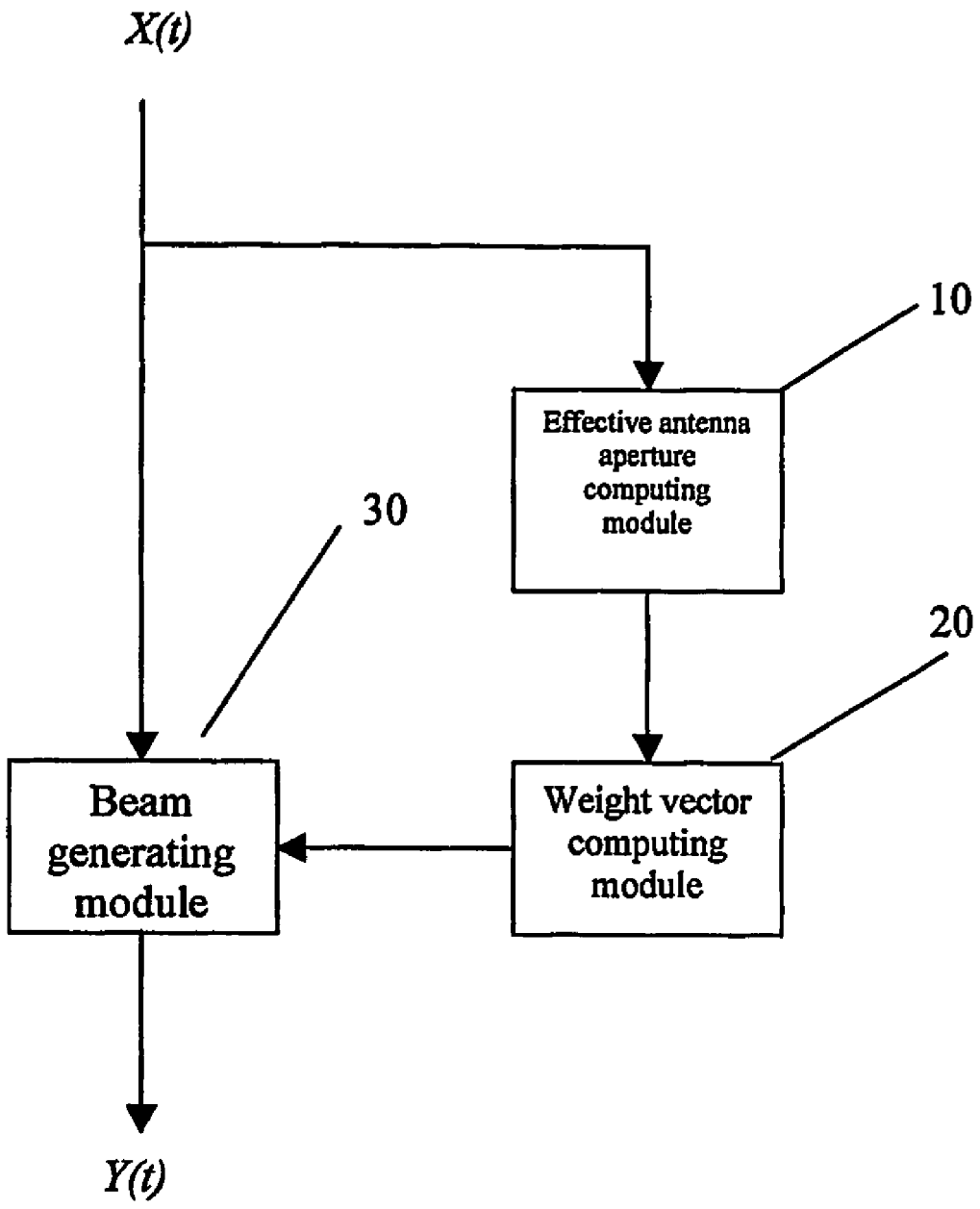
FIG. 3 is a block diagram illustrating a beamforming module based on broadband antenna in accordance with the present invention.

FIG. 3 is a block diagram illustrating a beamforming apparatus based on broadband antenna, comprising: an effective antenna aperture computing module 10, for measuring the frequency of input signals X(t) of the antenna and then determining the effective antenna aperture between the elements according to the measured frequency; a weight vector computing module 20, for computing the weight vector of each antenna element to the signals according to the determined effective antenna aperture and transmission function of the antenna array; a beam generating module 30, for multiplying the input signals X(t) with the weight vector of each said antenna element, combining them and outputting the beam signals Y(t).

The effective antenna aperture computing module 10, weight vector computing module 20 and beam generating module 30 as described above, can be implemented in either computer software or hardware.

In the following, descriptions will be given respectively to how the above beamforming method and apparatus is applied in time domain and frequency domain based on broadband antenna, by exemplifying the receipt and transmission of signals.

Figure 4:
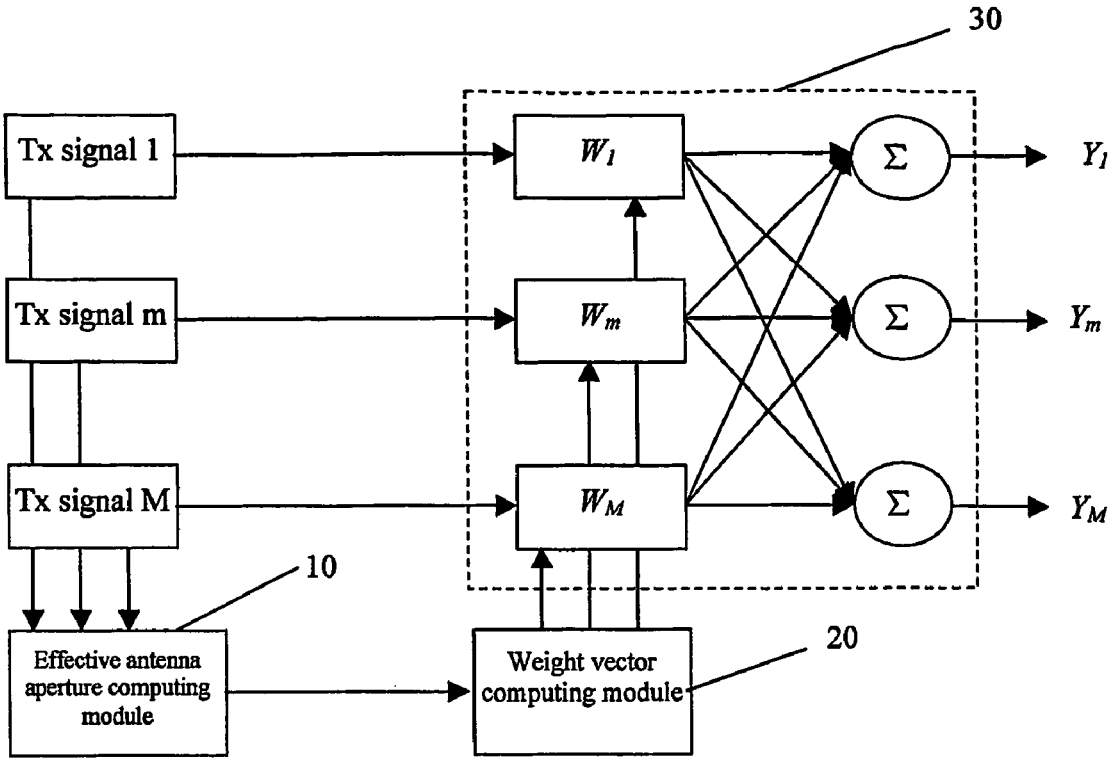
FIG. 4 is a block diagram illustrating a Tx beamforming apparatus based on broadband antenna and implemented in time domain in accordance with the present invention.

FIG. 4 illustrates the Tx beamforming apparatus based on broadband antenna implemented in time domain, comprising: an effective antenna aperture computing module 10; a weight vector computing module 20; a beam generating module 30.

As shown in FIG. 4, first the effective antenna aperture computing module 10 measures the frequency of each signal to be transmitted in time domain, and determines the effective antenna aperture between the elements of the antenna array as $d=\lambda_j/2$ according to the measured frequency; then the weight vector computing module 20 computes the weight vector of each antenna element to the signals according to the determined effective antenna aperture; last, the beam generating module 30 multiplies each signal in time domain with the computed weight vector, combines them and outputs the multi-beam signals with constant width, $(Y_1 \ldots Y_m \ldots Y_M)$.

Figure 5:
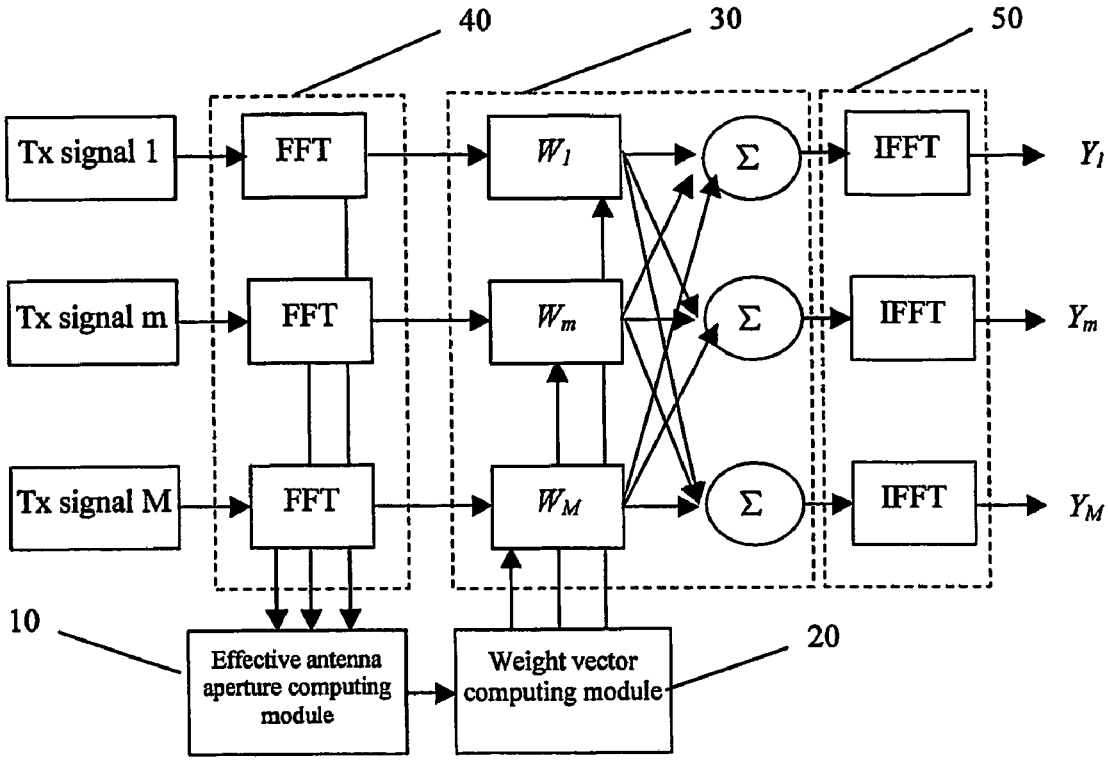
FIG. 5 is a block diagram illustrating a Tx beamforming apparatus based on broadband antenna and implemented in frequency domain in accordance with the present invention.

FIG. 5 depicts a Tx beamforming apparatus based on broadband antenna and implemented in frequency domain, comprising: effective antenna aperture computing module 10, weight vector computing module 20, beam generating module 30, FFT module 40 and IFFT module 50.

As shown in FIG. 5, the FFT module 40 first transforms each signal in time domain to be transmitted into signal in frequency domain. Then, the effective antenna aperture computing module 10 measures the frequency of each transformed signal in frequency domain and determines the effective antenna aperture between the elements of the antenna array as $d=\lambda_j/2$ according to the measured frequency. The weight vector computing module 20 computes weight vector or each antenna element according to the determined effective antenna aperture. Afterwards, the beam generating module 30 multiplies each signal in frequency domain with the computed weight vector, to output the multi-channel beam signals with constant width in frequency domain. Last, IFFT module 50 transforms each channel of beam signal into signal in time domain $(Y_1 \ldots Y_m \ldots Y_M)$.

Figure 6:
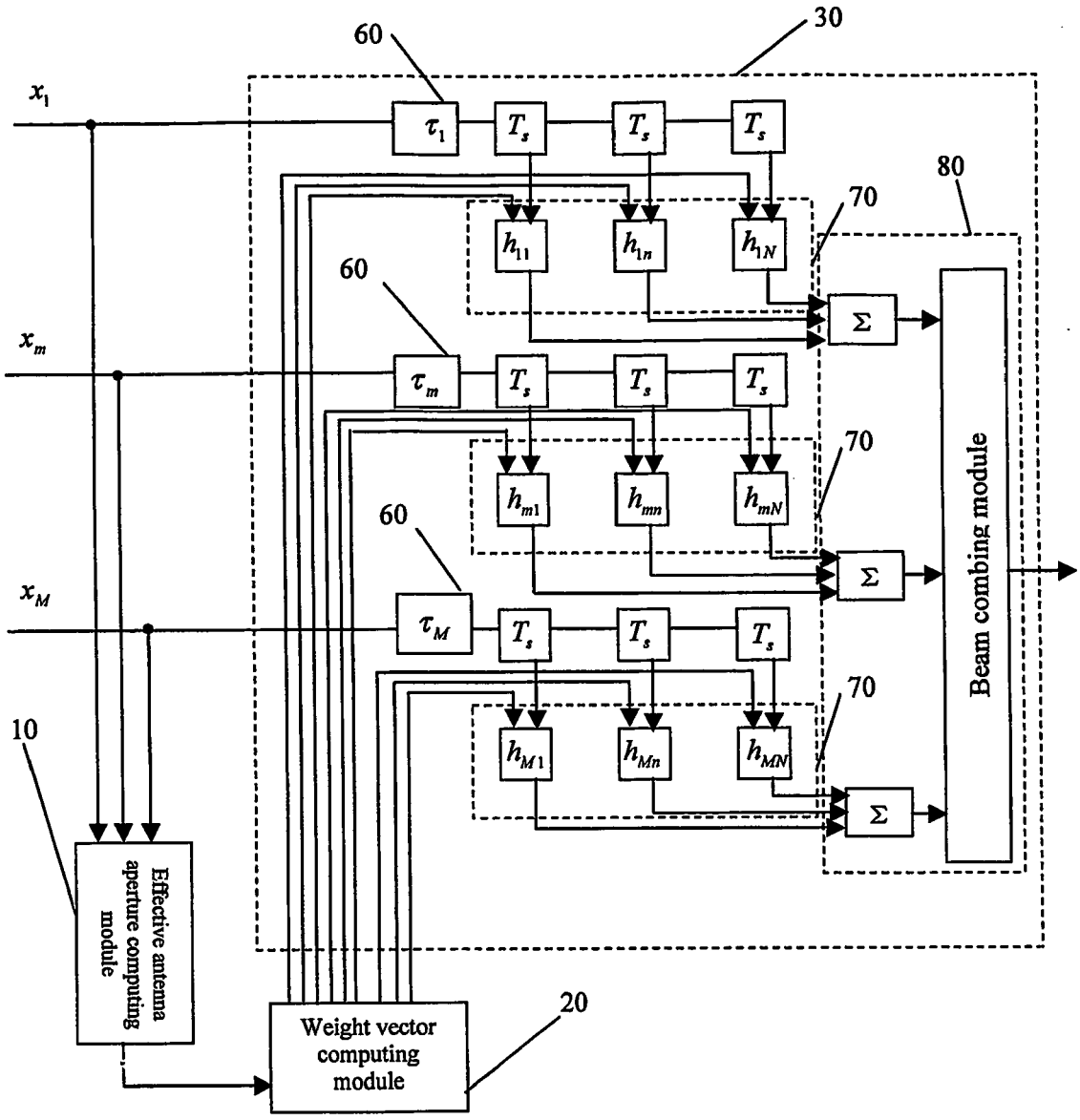
FIG. 6 is a block diagram illustrating an Rx beamforming apparatus based on broadband antenna and implemented in time domain in accordance with the present invention.

FIG. 6 illustrates an Rx beamforming apparatus based on broadband antenna implemented in time domain, comprising: effective antenna aperture computing module 10, weight vector computing module 20 and beam generating module 30 composed of a plurality of groups of delayers 60, a plurality of groups of weight adjusting modules 70 and a beam combining module 80.

As shown in FIG. 6, the effective antenna aperture computing module 10 measures the frequency of signal $(X_1 \ldots X_m \ldots X_M)$ in time domain received by each antenna element, and determines the effective antenna aperture between the elements of the antenna array as $d=\lambda_j/2$ according to the measured frequency; then the weight vector computing module 20 computes the weight vector of each antenna element according to the determined effective antenna aperture; the plurality of groups of delayers 60 perform a series of delaying operations on each received signal in time domain; the plurality of groups of weight adjusting modules 70 weight each delayed signal in time domain with the corresponding weight vector computed by weight vector computing module 70; last, the beam combining module 80 combines each weighted signals in time domain and outputs the combined beam signals with constant width.

Detailed description will be given below to how this apparatus works:

1. Computation of the Effective Antenna Aperture and the Weight Vector

First, the effective antenna aperture computing module 10 measures the frequency of input baseband signals, and determines the effective antenna aperture between the elements of the antenna array as $d=\lambda_j/2$ according to the measured frequency. Then, the weight vector computing module 20 computes the weight vector according to the determined effective antenna aperture. Specifically as:

(1) If the broadband signal is known waveform, its spectrum range is also known, then its pulse response in an element of the base array is h'(n); if the broadband signal is unknown, its pulse response in an element of the base array, h'(n), is to be determined by estimating its spectrum range with FFT and time/frequency analysis.

(2) When the odds caused by the elements' receiving broadband signal are eliminated, the weight coefficient $h_{mn}$ (or denoted as $h_m(n)$) should satisfy equation (4) (without considering the channel effect):

$$y(t)=x(t)=x(t)\otimes h'(n)\otimes h_m(n) \tag{4}$$

where $\otimes$ denotes convolution in time domain.

(3) Compute the weight coefficient with equation (4) to obtain $h_{\cdot n}=h_{mn}$ (m=1, . . . , M), where $h_{\cdot n}$ denotes the weight coefficient of one element in time domain and is relevant to the effective antenna aperture.

(4) Determine the weight coefficients $h_{m\cdot}$ to acquire the scheduled beam shape through weighting like Chebyshev or Butterworth, wherein $h_{m\cdot}$ denotes the weight coefficients of all elements at the same time.

(5) Determine the weight coefficient $h_{mn}$ with $h_{m\cdot}$ and $h_{\cdot n}$:

$$h_{mn}=h_{\cdot n}\times h_{m\cdot} \tag{5}$$

(6) Supply each generated weight coefficient $h_{mn}$ to each group of weight adjusting modules 70.

2. Weighting

As shown in FIG. 6, the input signals are delayed $\tau_m=(m-1)\cdot d/c\cdot\sin(\alpha_0)$, wherein $\tau_m$ is the delay relative to the reference point, for forming beams with typical viewing angle as $\alpha_0$ and $T_s$ is a delaying unit. Each signal that has been performed a series of delaying operations, is multiplied with each weight coefficient supplied by the weight vector computing module 20 to get two-dimension time-space processed multi-beam signals.

3. Combining

Each channel of weighted signal is combined in the beam combining module 80, to get the single-channel digital signal with constant beam width.

Figure 7:
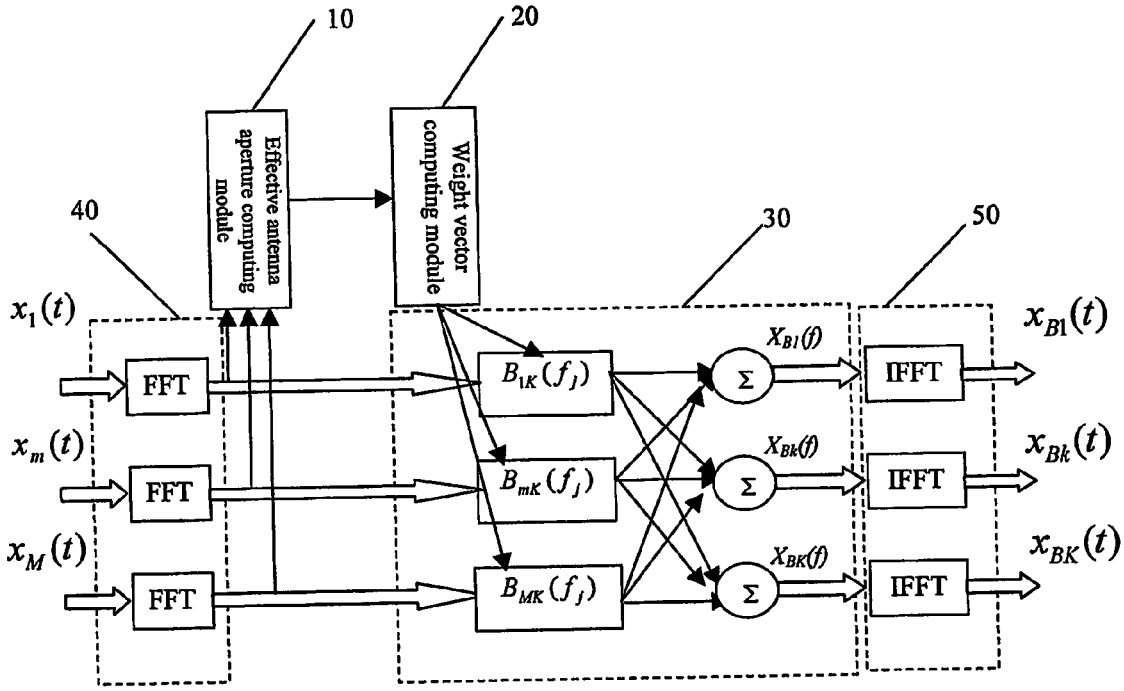
FIG. 7 is a block diagram illustrating an Rx beamforming apparatus based on broadband antenna and implemented in frequency domain in accordance with the present invention.

FIG. 7 charts an Rx beamforming apparatus based on broadband antenna implemented in frequency domain, where $x_m(t)$ is the mth channel of input signal in time domain, $X_{Bk}(f)$ the output of the kth beam with directional angle $\alpha_k$ in frequency domain, $x_{Bk}(t)$ the eventual output in time domain, K the number of the formed beams, and $B_{mk}(f_j)$ the transform matrix. It can be represented in Equation (6):

$$B(f_j) = W_j(W_j^H W_j)^{\frac{1}{2}} \tag{6}$$

where $W_j=[w_{j1}, w_{j2} \ldots w_{jk} \ldots w_{jK}]$ and $w_{jk}$ is the weight vector of the kth beam. Through computing with Equation (3), $w_{jk}$ can be expressed as in Equation (7):

$$\begin{aligned} w_{jk} &= diag[1, e^{-j2\pi f_j(d/c)\sin(\alpha_k)} \ldots e^{-j2\pi f_j(d/c)\sin(\alpha_k)(m-1)} \ldots \\ &\quad e^{-j2\pi f_j(d/c)\sin(\alpha_k)(M-1)}]\times w_{j0} \\ &= diag(\partial(f_j, \alpha_k))\times w_{j0} \end{aligned} \tag{7}$$

As shown in FIG. 7, first, the input signal in time domain $x_m(t)$ is FFT transformed into signal in frequency domain.

Second, the effective antenna aperture computing module 10 measures the frequency of the signal in frequency domain and determines the effective antenna aperture between the elements of the antenna array as $d=\lambda_j/2$ according to the measured frequency. Third, the weight vector computing module 20 computes the weight vector of each antenna element to the signal according to the determined effective antenna aperture and transmission function of the antenna array, and provides the computed weight coefficients to the transform matrix of each channel. Fourth, each channel of signal in frequency domain is weighted with the transform matrix of the corresponding channel, and combined by a plurality of signal combiners to generate multi-beam signals in frequency domain. Last, the beam signals in frequency domain are transformed into beam signals in time domain through IFFT.

Beneficial Results of the Invention

As described above, when the frequency of the signals inputted to the antenna element changes from original frequency $f_0$ to frequency $f_j$, the antenna array should be re-sampled at the antenna element to ensure that its effective aperture changes from $d=\lambda_0/2$ to $d'=\lambda_j/2$, thus to keep the width of the antenna beam constant with the two frequencies. The weight vector corresponding to frequency $f_1$ can be computed according to the effective antenna aperture of the new antenna array and the transmission function of the continuous antenna array. Output of beams with constant width can be obtained by multiplying the input signals with the weight vector, thus the distortion of the processed broadband signals is eliminated.

Moreover, when the above method and apparatus for beamforming with constant width are applied in mobile terminals with array antennas, through respectively weighting the input signals which have been performed on a series of delaying operations and combining the two-dimension time-space processed signals to obtain single-channel digital signals, the warp produced by the antenna array elements when transmitting and receiving signals, can be effectively reduced, thus to improve the communication quality dramatically.

It's to be understood by those skilled in the art that the beamforming method and apparatus as proposed in the present invention is applicable to broadband wireless transceiving systems, base stations and mobile terminals of next generation (3G and 4G) communication system, chipsets and components for use in array antennas and broadband antennas.

Furthermore, it's to be understood by those skilled in the art that the beamforming method and apparatus as proposed in the present invention can be modified considerably without departing from the spirit and scope of the invention as defined by the appended claims.

The invention claimed is:

1. A beam shaping method based on broadband antenna, comprising:

measuring a frequency of input signals of an antenna, the antenna comprising an antenna array, wherein the input signals can include signals with different frequencies, including an original frequency and a second frequency different from the original frequency;

determining an effective antenna aperture between elements of the antenna array according to a measured frequency, wherein determining includes re-sampling at the antenna elements to ensure that the antenna's effective aperture changes from a first effective aperture to a second effective aperture to keep a beam width of the antenna constant with the two frequencies;

computing a weight vector of each element of the antenna array to the input signals according to (i) the determined effective antenna aperture and (ii) a transmission function of the antenna array; and multiplying each of the input signals with a corresponding one of said weight vector of each element of the antenna array to the input signals, combining them into beam signals with constant beam width and outputting the beam signals.

2. The beam shaping method based on broadband antenna according to claim 1, wherein said step of multiplying the input signals with the corresponding weight vectors further includes:

performing a series of delaying operations on the input signals;

multiplying each delayed signal with the corresponding weight vector, and combining each delayed weighted signal.

3. The beam shaping method based on broadband antenna according to claim 1, further comprising:

performing FFT (Fast Fourier Transform) first so as to transform input signals into signals in frequency domain before measuring the frequency of input signals, and performing IFFT (Inverse Fast Fourier Transform) so as to transform the combined signals in frequency domain into signals in time domain after combining the signals weighted by each element of the antenna array.

4. The beam shaping method based on broadband antenna according to claim 1, wherein said effective antenna aperture between elements is $d=\lambda/2$, wherein $\lambda$ is the wavelength of said input signals.

5. The beam shaping method based on broadband antenna according to claim 1, is performed by at least one of the base station and the mobile terminal.

6. A beam shaping apparatus based on broadband antenna, comprising:

an effective antenna aperture computing module, for measuring a frequency of input signals of an antenna, the antenna comprising an antenna array, wherein the input signals can include signals with different frequencies, including an original frequency and a second frequency different from the original frequency, and then determining an effective antenna aperture between elements of the antenna array according to a measured frequency, wherein determining includes re-sampling at the antenna elements to ensure that the antenna's effective aperture changes from a first effective aperture to a second effective aperture to keep a beam width of the antenna constant with the two frequencies;

a weight vector computing module, for computing the a weight vector of each element of the antenna array to said input signals according to (i) the determined effective antenna aperture and (ii) a transmission function of the antenna array; and a beam generating module, for multiplying each of said input signals with a corresponding one of said weight vector of each element of the antenna array to said input signals, and then combining them into beam signals with constant beam width and outputting the beam signals.

7. The beam shaping apparatus based on broadband antenna according to claim 6, wherein said beam generating module further includes:

a plurality of groups of delayers, each group for performing a series of delaying operations on the input signals;

a plurality of groups of weight vector adjusting modules, each group for multiplying each delayed signal with said corresponding weight vector; and a beam combining module, for combining the weighted signals, and outputting the combined signals.

8. The beam shaping apparatus based on broadband antenna according to claim 6, further comprising:

a time/frequency transforming module, for performing FFT (Fast Fourier Transform) to the input signals of the antenna, so as to provide the transformed signals in frequency domain to said effective antenna aperture computing module; and a frequency/time transforming module, for performing IFFT (Inverse Fast Fourier Transform) to the beam signals in frequency domain outputted from said beam generating module, to acquire the beam signals in time domain.

9. The beam shaping equipment based on broadband antenna according to claim 6, wherein said effective antenna aperture between elements of the antenna array is $d=\lambda/2$, where $\lambda$ is the wavelength of said input signals.

10. A base station system, comprising:

a radio signal transceiving module, for receiving or transmitting radio signals;

an effective antenna aperture computing module, for measuring a frequency of input signals of an antenna of the base station, the antenna comprising an antenna array, wherein the input signals can include signals with different frequencies, including an original frequency and a second frequency different from the original frequency, and then determining an effective antenna aperture between elements of the antenna array of the base station according to a measured frequency, wherein determining includes re-sampling at the antenna elements to ensure that the antenna's effective aperture changes from a first effective aperture to a second effective aperture to keep a beam width of the antenna constant with the two frequencies;

a weight vector computing module, for computing a weight vector of each element of the antenna array of the base station to said input signals according to (i) the determined effective antenna aperture and (ii) a transmission function of the antenna array; and a beam generating module, for multiplying each of said input signals with a corresponding one of the weight vector of each element of the antenna array of the base station to said input signals, then combining them into beam signals with constant beam width and outputting the beam signals.

11. The base station system according to claim 10, wherein said beam generating module further includes:

a plurality of groups of delayers, each group for performing a series of delaying operations on the input signals;

a plurality of groups of weight adjusting modules, each group for multiplying each delayed signal with said corresponding weight vector; and a beam combining module, for combining said weighted signals and outputting the combined signals.

12. The base station system according to claim 10, further comprising:

a time/frequency transforming module, for performing FFT (Fast Fourier Transform) to input signals of the antenna of the base station, so as to provide signals in frequency domain to said effective antenna aperture computing module; and a frequency/time transforming module, for performing IFFT (Inverse Fast Fourier Transform) to the beam signals in frequency domain combined and outputted from said beam generating module, so as to acquire the beam signals in time domain.

13. The base station system according to claim 10, wherein said effective antenna aperture between elements of antenna array is $d=\lambda/2$, where $\lambda$ is the wavelength of said input signals.

14. A mobile terminal, comprising:

a radio signal transceiving module, for receiving or transmitting radio signals;

an effective antenna aperture computing module, for measuring a frequency of input signals of an antenna of the mobile terminal, the antenna comprising an antenna array, wherein the input signals can include signals with different frequencies, including an original frequency and a second frequency different from the original frequency, and then determining an effective antenna aperture between elements of the antenna array of the mobile terminal according to a measured frequency, wherein determining includes re-sampling at the antenna elements to ensure that the antenna's effective aperture changes from a first effective aperture to a second effective aperture to keep a beam width of the antenna constant with the two frequencies;

a weight vector computing module, for computing a weight vector of each element of the antenna array of the mobile terminal to said input signals according to (i) the determined effective antenna aperture and (ii) a transmission function of the antenna array; and a beam generating module, for multiplying each of said input signals with a corresponding one of the weight vector of each element of the antenna array of the mobile terminal to said input signals, then combining them into beam signals with constant beam width and outputting the beam signals.

15. The mobile terminal according to claim 14, wherein said beam generating module further includes:

a plurality of groups of delayers, each for performing a series of delaying operations on the input signals;

a plurality of groups weight adjusting modules, each group for multiplying each delayed signal with said corresponding weight vector; and a beam combining module, for combining said weighted signals and outputting the combined signals.

16. The mobile terminal according to claim 14, further comprising:

a time/frequency transforming module, for performing FFT (Fast Fourier Transform) to the input signals of the antenna of said mobile terminal, so as to provide the transformed signals in frequency domain to said effective antenna aperture computing module; and a frequency/time transforming module, for performing IFFT (Inverse Fast Fourier Transform) to the beam signals in frequency domain combined and outputted from said beam generating module, so as to acquire beam signals in time domain.

17. The mobile terminal according to claim 14, wherein said effective antenna aperture between elements of the antenna array is $d=\lambda/2$, where $\lambda$ is the wavelength of said input signals.

* * * * *